US005216213A

United States Patent [19]

Sato

[11] Patent Number: 5,216,213

[45] Date of Patent: Jun. 1, 1993

[54] PRESSURE SWITCH

[75] Inventor: Kenichi Sato, Shizuoka, Japan

[73] Assignee: Yazaki Corporation, Tokyo, Japan

[21] Appl. No.: 783,934

[22] Filed: Oct. 29, 1991

[30] Foreign Application Priority Data

Oct. 31, 1990 [JP] Japan ..... 2-113521[U]

[51] Int. Cl.[5] ..... H01H 35/40; H01H 9/04

[52] U.S. Cl. ..... 200/83 R; 200/302.1; 200/306

[58] Field of Search ..... 200/83 R, 83 N, 302.1-302.3, 200/306

[56] References Cited

U.S. PATENT DOCUMENTS 4,469,922 9/1984 Fukuda et al. ..... 200/83 R
4,524,254 6/1985 Yoshida et al. ..... 200/83 R
4,636,598 1/1987 Suzuki ..... 200/83 N
4,767,898 8/1988 Yasuda et al. ..... 200/83 R

*Primary Examiner*—J. R. Scott
*Attorney, Agent, or Firm*—Sughrue, Mion, Zinn, Macpeak & Seas

[57] ABSTRACT

A pressure switch comprises a diaphragm held between and insulating cap and a conductive body to form an atmosphere chamber by the insulating cap and the diaphragm, and a pressure chamber by the conductive body and the diaphragm; a fixed contact provided on the insulating cap; a movable contact, provided on the diaphragm, for contacting/discontacting the fixed contact to detect a pressure, in the pressure chamber, reached to a predetermined value; communication device, provided with the insulating cap, for communicating the atmosphere chamber with the atmosphere; and water proof device for covering the communication device to prevent water form intruding into the atmosphere chamber.

7 Claims, 7 Drawing Sheets

PRESSURE SWITCH

BACKGROUND OF THE INVENTION

The present invention generally relates to a pressure switch, and particularly relates to a pressure switch in which a diaphragm is held between an insulating cap and a conductive body so that an atmosphere chamber is formed by the insulating cap and the diaphragm and a pressure chamber is formed by the conductive body and the diaphragm, whereby pressure is detected by contact/discontact of a movable contact provided on the diaphragm with/from a fixed contact provided on the insulating cap when pressure in the pressure chamber becomes a predetermined value.

As such a pressure switch, conventionally, there has been a normally-closed type negative pressure switch having such a configuration as shown in FIG. 12, in which a contact opens/closes when negative pressure of, for example, an engine reaches to a predetermined value to thereby generate a signal for controlling the engine or the like.

An illustrated pressure switch 1 is constituted by a metallic conductive body 11 having a screw portion 11*a* to be screwed to a predetermined position of an engine, and an insulating cap 12 to be fit into a concave portion 11*b* of the conductive body 11 and integrated with the conductive body 11 through inward bending and caulking of the opening circumferential surface portion of the conductive body 11. A concave portion 12*a* is formed in the portion of the insulating cap 12 which is fit into the conductive body 11 so as to co-operate with the concave portion of the conductive body 11.

A diaphragm 13 is held, at its circumferential edge portion 13*a*, between the conductive body 11 and the insulating cap 12 which are integrated in such a manner as described above so that a pressure chamber 14 is formed by the diaphragm 13 and the concave portion 11*b* of the conductive body 11 and an atmosphere chamber 15 is formed by the diaphragm 13 and the concave portion 12*a* of the insulating cap 12.

In the center of the diaphragm 13, a center disc 16 acting as a movable contact exposed to the atmosphere chamber 15 is caulked, through a spacer 17, on the pressure chamber 14 side. The diaphragm 13, to which the center disc 16 is fixed, is urged to the atmosphere chamber 15 by a coil spring 19 which is inserted into a screw hole 11*c* of the conductive body 11 formed coaxially with the screw portion 11*a* and which is compressed in a loaded state between the diaphragm 13 and double nuts 18 screwed into the screw hole 11*c*. The spring force of the coil spring 19 is adjusted by the degree to which the nuts 18 are screwed. In order to ensure the looseness of the double nuts 18, a caulking member 18*a* is secured in the screw hole 11*c*, and a communicating hole 18*b* for applying engine negative pressure of, for example, a turbo car or the like is formed in the center thereof.

In addition, a fixed pin 20 is positioned, through insert formation, in the concave portion 12*a* of the insulating cap 12, and an external output terminal 21 having an L-shaped section and a cap-like conductive board 22 acting as a multipoint fixed contact are caulked on the fixed pin 20 through a spacer 23. The external output terminal 21 is projected partly outside so as to constitute, together with a connector housing 12*b* formed integrally with the insulating cap 12, a female connector for the electrical connection with a not-shown engine control circuit. In a hole 12*c* for leading the external output terminal 21 to the outside, an air vent groove 12*c* is formed so as allow make the atmosphere chamber 15 to communicate with the atmosphere. In addition, between the external output terminal 21 and the conductive board 22, a reception plate 24 is sandwiched so as to prevent water from adhering to a contact directly even if the water comes into the inside of the switch.

In such a configuration, when a relatively small amount of negative pressure is asserted on the pressure chamber 14 which is not sufficient to move the diaphragm 13 against the spring force of the coil spring 19, a movable contact constituted by the center disc 16 is in contact with a fixed contact constituted by the conductive board 22 as illustrated so that a switch constituted by these contacts is in a ON state. An electric path through the external output terminal 21, the reception plate 24, the conductive board 22, the center disc 16, the spacer 17, the coil spring 19, the nut 18 and the conductive body 11 to a body earth is therefore formed. When the engine negative pressure becomes large enough to move the diaphragm 13 to the pressure chamber 14 side against the spring force of the coil spring 19, on the contrary, the movable contact constituted by the center disc 16 moves together with the diaphragm 13 away from the fixed contact constituted by the conductive board 22 so that the switch constituted by these contacts is turned off to open the above-mentioned electric path. Thus, it is possible to detect the fact that the negative pressure becomes larger than a predetermined value.

In the above-mentioned conventional pressure switch 1, however, there has been the following problem. If water adheres to the entrance of the air groove 12*c*, the water enters the atmosphere chamber 15 directly through the air groove 12*c* as a result of intake operation caused by the movement of the diaphragm 13 because the atmosphere chamber 15 is made to communicate with the atmosphere directly through the air groove 12*c* formed along the external output terminal 21 in the insulating cap 12. The water entering the atmosphere chamber 15 intrudes into a mutual contact portion between conductive members to cause corrosion on the contact portion to generate a contact fault, so that the pressure switch erroneously operates to perform erroneous engine control.

SUMMARY OF THE INVENTION

In view of the conventional problem as described above, it is an object of the present invention provide a pressure switch in which water cannot enter an atmosphere chamber through an air vent hole for making the atmosphere chamber communicate with the atmosphere to hereby eliminate the cause of the erroneous operation.

In order to attain the above object, according to the present invention, the pressure switch in which a diaphragm is held between an insulating cap and a conductive body so that an atmosphere chamber is formed by the insulating cap and the diaphragm and a pressure chamber is formed by the conductive body and the diaphragm, whereby pressure is detected by contact/discontact of a movable contact provided on the diaphragm with/from a fixed contact provided on the insulating cap when pressure in the pressure chamber becomes a predetermined value, wherein a groove is formed on an outer circumference of the insulating cap along a circumferential surface thereof so that one end of the groove communicates with the atmosphere chamber; and in that a water-proof cover is provided to cover the groove, and a small diameter air vent hole is formed in the water-proof cover so as to make the other end of the groove communicate with the atmosphere.

In addition, the above-mentioned pressure switch is further characterized in that the water-proof cover is formed of a water- repellent material.

Further in order to attain the above object, according to the present invention, the pressure switch in which a diaphragm is held between an insulating cap and a conductive body so that an atmosphere chamber is formed by the insulating cap and the diaphragm and a pressure chamber is formed by the conductive body and the diaphragm, whereby pressure is detected by contact-/discontact of a movable contact provided on the diaphragm with/from a fixed contact provided on the insulating cap when pressure in the pressure chamber becomes a predetermined value, wherein a circumferential groove is formed on an outer circumference of the insulating cap so as to communicate with the atmosphere chamber, a water-proof cover is mounted so as to cover the circumferential groove to thereby form a space along the circumferential groove, and an opening, on the space side, of an air vent hole for making the space communicate with the atmosphere chamber is projected into the space, and a gap for making the space communicate with the atmosphere and for discharging water which comes into the space is formed between the water-proof cover and an exceptive portion covered therewith.

In addition, the above-mentioned pressure switch is further characterized in that a water-proof plate for preventing water from intruding into the gap directly is provided on the insulating cap to cover the water-proof cover.

In the above configuration, the groove is formed on the outer circumference of the insulating cap along the circumferential surface thereof so that one end of the groove communicates with the atmosphere chamber, and the water-proof cover is provided to cover the groove, the small diameter air vent hole being formed in the water-proof cover so as to make the other end of the groove communicate with the atmosphere. Since the atmosphere chamber does not communicate with the atmosphere directly, even if water intrudes through the air vent hole, the water must pass through the groove in the outer circumferential surface of the insulating cap so that the water cannot reach the atmosphere chamber because it evaporates or the like on the way.

In addition, since the water-proof cover is formed of a water-repellent material, water is repelled at the entrance of the air vent hole, so that the quantity of water intruding into the groove of the insulating cap is minimized.

In addition, the circumferential groove formed in the outer circumference of the insulating cap so as to communicate with the atmosphere chamber is covered with the water-proof cover to thereby form the space, and the opening on the space side, of the air vent hole for making the space communicate with the atmosphere chamber is projected into the space. Further, the gap for making the space communicate with the atmosphere and for discharging water which comes into the space is formed between the water-proof cover and a portion covered therewith. Accordingly, water intruding into the space through the gap cannot enter the atmosphere chamber, and the intruding water is discharged through the gap. That is, there is no case where water intrudes into the atmosphere chamber.

Further in addition, since the water-proof plate provided in the insulating cap covers the water-proof cover so as to prevent water from intruding into the gap directly, it seldom happens that water intrudes into the circumferential groove through the gap.

DETAILED DESCRIPTION OF THE PREFERRED EMBODIMENTS

Embodiments of the present invention will be described with reference to the drawings.

Figure 11:
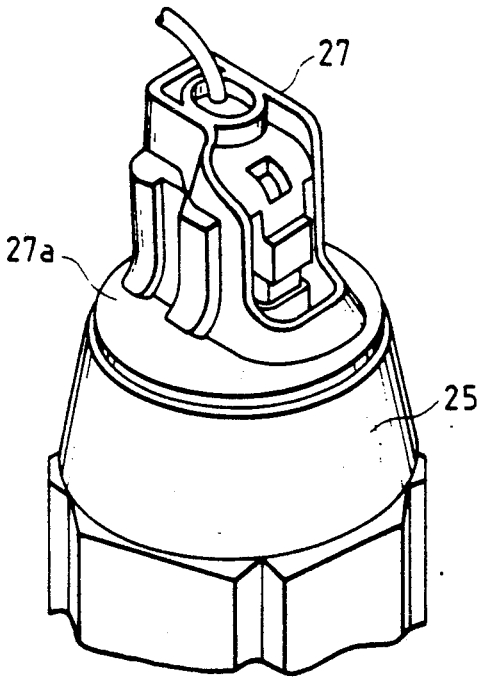
Figure 12:
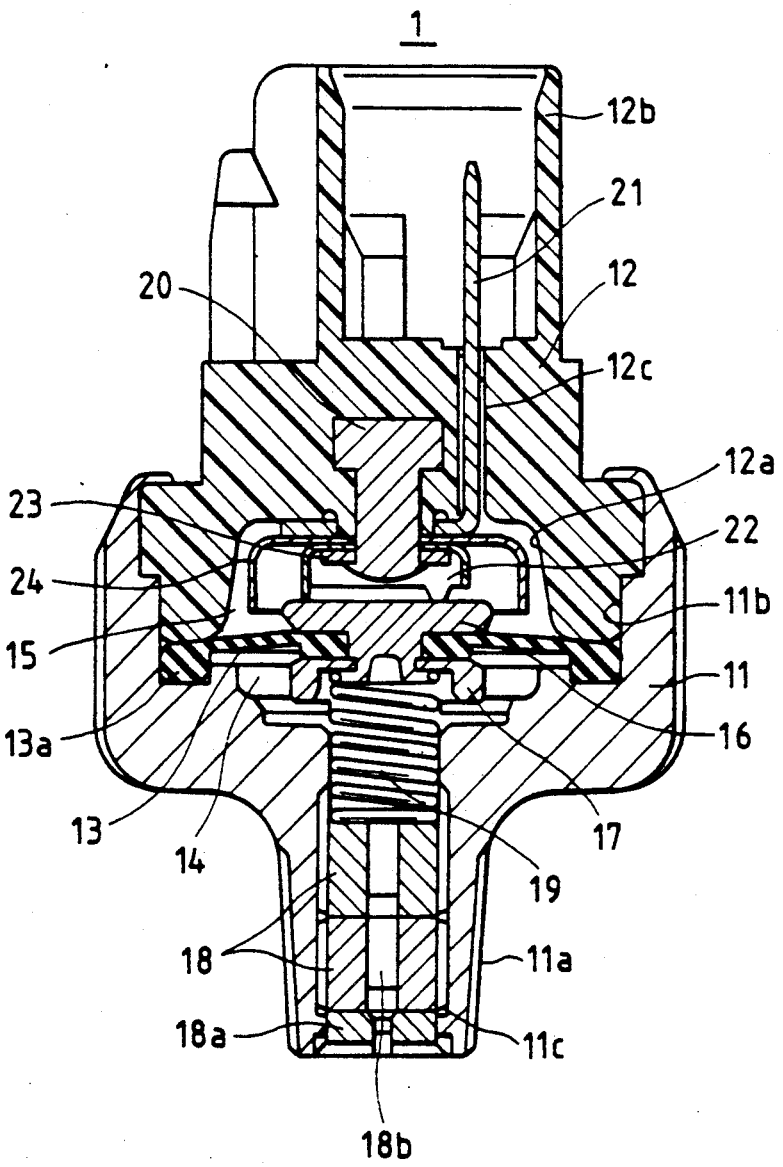
FIG. 12 is a diagram illustrating a conventional pressure switch.

FIGS. 1 to 11 show embodiments according to the present invention, and in FIGS. 1 to 11, parts the same as those in the pressure switch described along FIG. 12 are referenced correspondingly.

FIGS. 1 to 4 show a first embodiment of the pressure switch according to the present invention, in which an air vent groove **12*c* is formed substantially along the entire outer circumference of an insulating cap 12, and one end of the air vent groove 12*c* communicates with an atmosphere chamber 15 through an air vent hole 12*d* formed in the insulating cap 12. The outer circumference of the insulating cap 12 is covered with a water-proof cover 25 formed of a water-repellent composite resin material having a slight elasticity to thereby close the above- mentioned air vent groove 12*c*. A small diameter air vent hole 25*a* for making the other end of the air vent groove 12*c* communicate with the atmosphere is formed in the water-proof cover 25**.

By the above-mentioned configuration, the atmosphere chamber 15 communicates with the atmosphere through the air vent hole **12*d* and the air vent groove 12*c* of the insulating cap 12, and the small-diameter air vent hole 25*a* of the water-proof cover 25, and the intake and discharge of air is not performed through portions other than this small-diameter air vent hole 25*a*, so that there is no case where water intrudes through portions other than the air vent hole 25*a***.

In addition, since the water-proof cover 25 is formed of a water-proof material, water is repelled by the water-proof cover 25, so that it is difficult for water to adhere to the small- diameter air vent hole **25*a* so that little water enters the air vent groove 12*c* through the small-diameter air vent hole 25*a*. Even if water happens to intrude into the air vent groove 12*c* through the small-diameter air vent hole 25*a*, the air vent groove 12*c* formed substantially around the entire insulating cap 12 is long in length and large in volume, so that the water is released to the outside through the small diameter air vent hole 25*a* because of evaporation or the like. Therefore, it is not easy for the water to intrude into the atmosphere chamber 15**.

Figure 1:
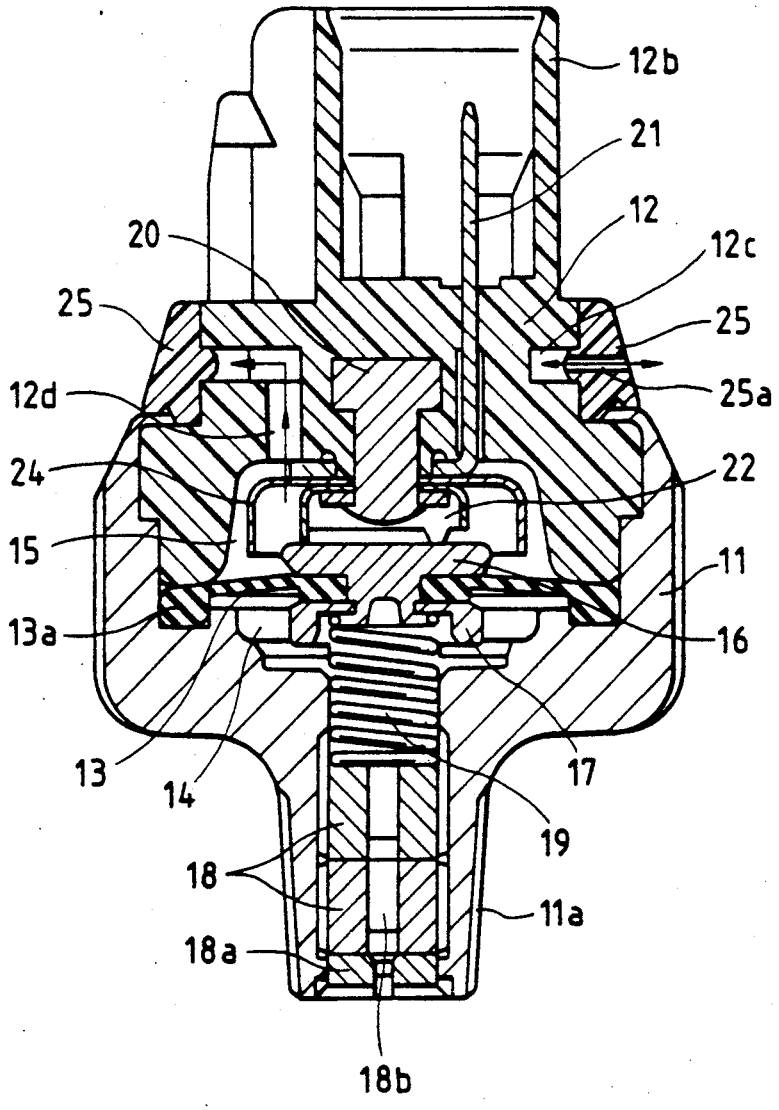
FIGS. 1 to 4 are diagrams illustrating a first embodiment of the pressure switch according to the present invention.
Figure 2:
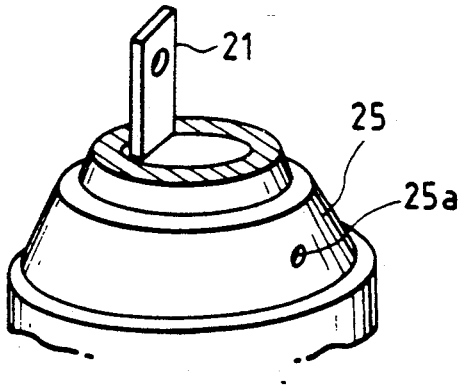
Figure 3:
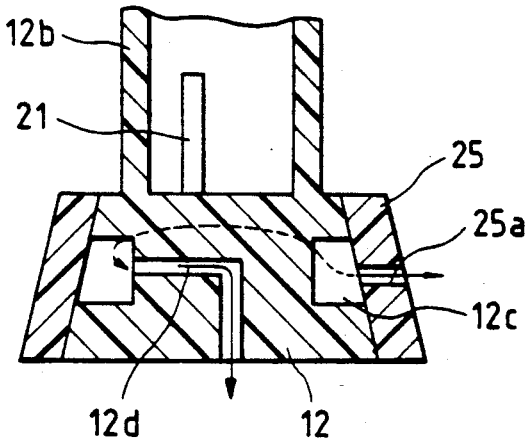
Figure 4:
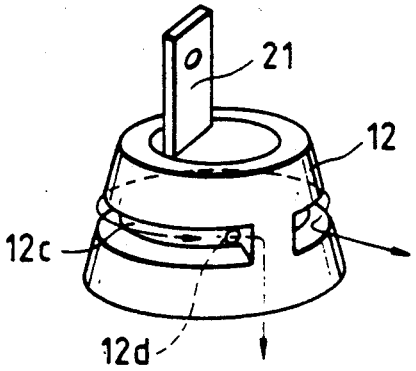
Figure 5:
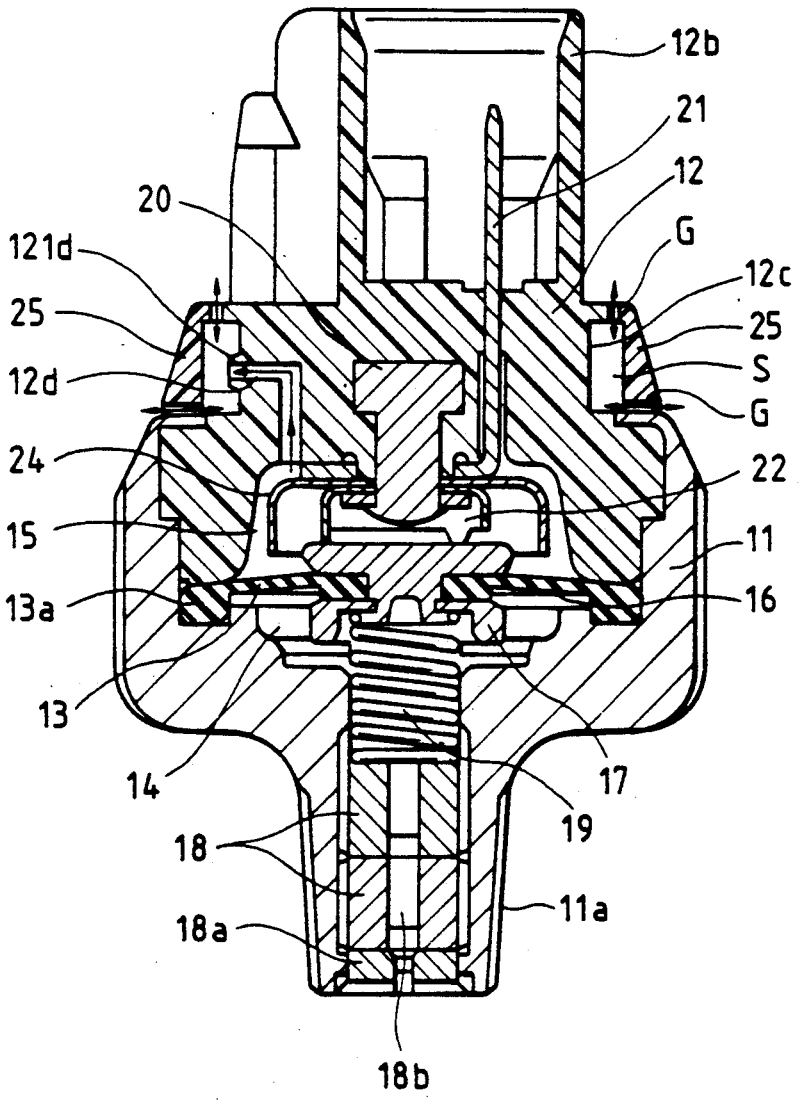
FIGS. 5 to 7 are diagrams illustrating a second embodiment of the pressure switch according to the present invention.
Figure 6:
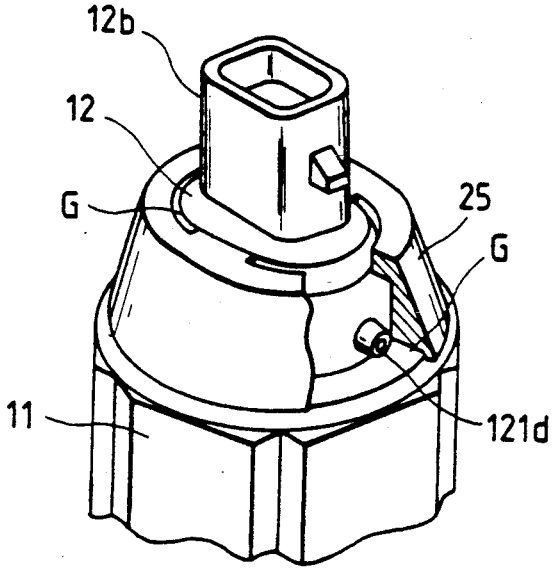
Figure 7:
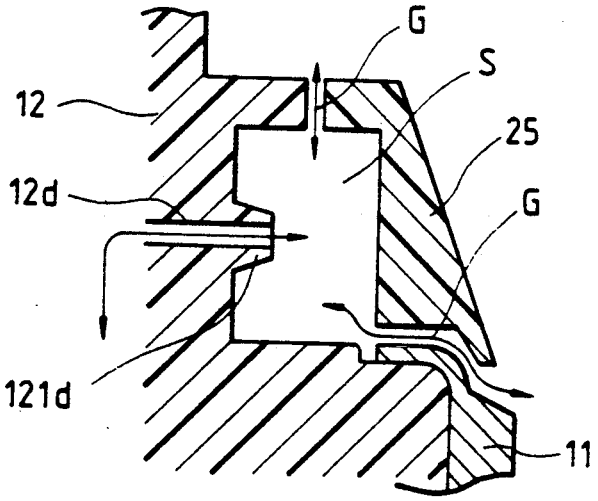

FIGS. 5 to 7 show a second embodiment of the pressure switch according to the present invention, in which an air vent groove 12*c* is formed as a circumferential groove along the entire outer circumference of an insulating cap 12, and the air vent groove 12*c* is closed by a water-proof cover 25 attached to the outer circumference of the insulating cap 12, forming a space S along the circumferential groove. An air vent hole 12*d* for communicating this space S with an atmosphere chamber 15 is formed in the insulating cap 12, and an opening portion 121*d* of the air vent hole 12*d* on the above-mentioned space S side is projected into the space S.

In addition, between the water-proof cover 25 attached to the outer circumference of the insulating cap 12 and the outer circumferential side of the insulating cap 12, and between the water-proof cover 25 and a metal body 11 contacted with the water-proof cover 25, very small gaps G, for example, not more than 0.3 mm, for communicating the space S communicate with the atmosphere are formed partially along the entire circumference, so that ventilation is performed through the gaps G formed in the upper and lower portions of the space S, and discharge of water entering the space S is also performed through the gaps G.

By the above-mentioned configuration, the atmosphere chamber 15 communicates with the atmosphere through the air vent hole 12*d* and the air vent groove 12*c* of the insulating cap 12 and the gaps G, and intake and discharge of air is performed through these portions. Since the gaps G are very small, even if water then is on the outside of the switch, it is difficult for the water to intrude through the gaps G into the space S inside the water- proof cover 25.

In addition, since the opening portion 121*d* of the air vent hole 12*d* is projected into the space S, even if water enters the space S through the gaps G, it is difficult for the water to enter the air vent hole 12*d*, and water entering the space S through one gap G is discharged through the other gap G.

In addition, since the gaps G are formed along the entire circumference, even in the case where corrosion-protective wax or the like is applied or dust adheres, there is no case where the gaps G are completely clogged so that it is possible to ensure ventilation.

Figure 8:
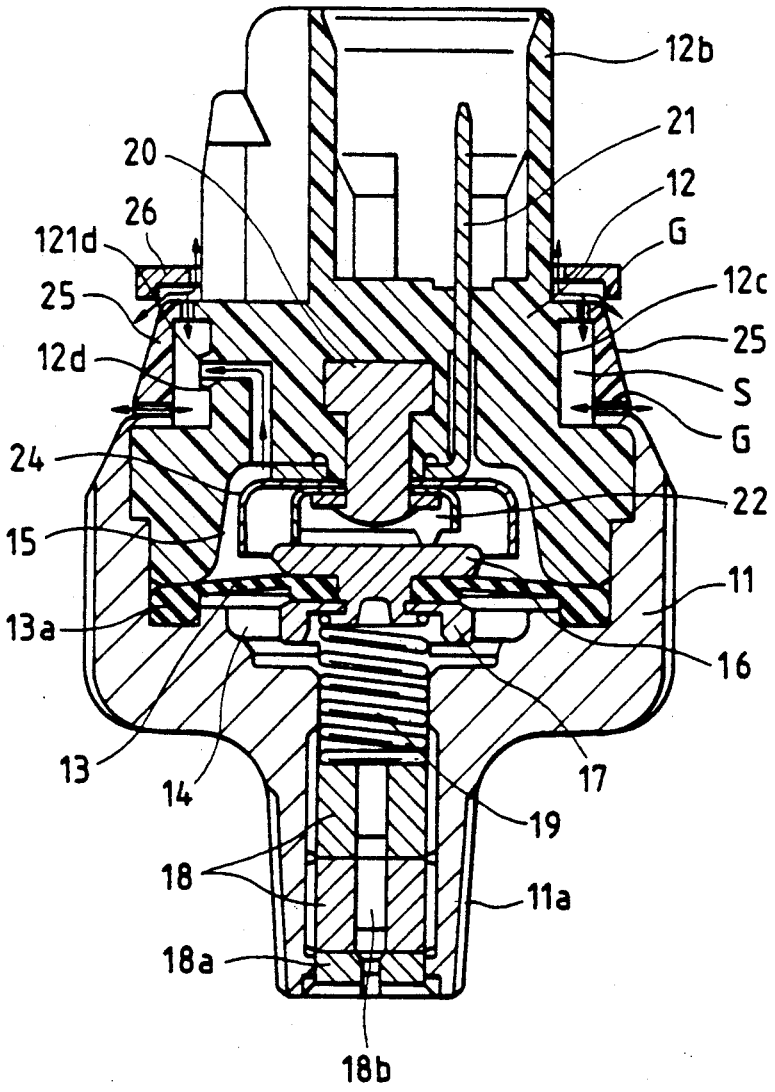
FIGS. 8 to 11 are diagrams illustrating modification examples of the second embodiment.
Figure 10:
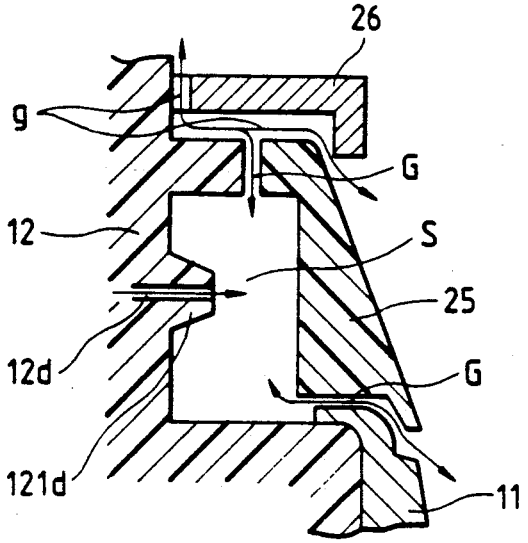

FIGS. 8 and 10 show an embodiment which is a partial modification of the above-mentioned second embodiment. In this embodiment, in order to prevent high pressure water from entering into a gap G between an insulating cap 12 and a water-proof cover 25 directly, so as to thereby prevent water from intruding into the gap G directly, a ring-like water-proof plate 26 is attached to the insulating cap 12 so as to cover the gap G. A gap g, to ensure an air path, is formed between a part of the inner circumference of the water-proof plate 26 and the water-proof cover 25. The water-proof plate 26 also acts to intercept wax when corrosion-protective wax is sprayed thereto, thereby preventing the gap G from being clogged with the wax.

Figure 9:
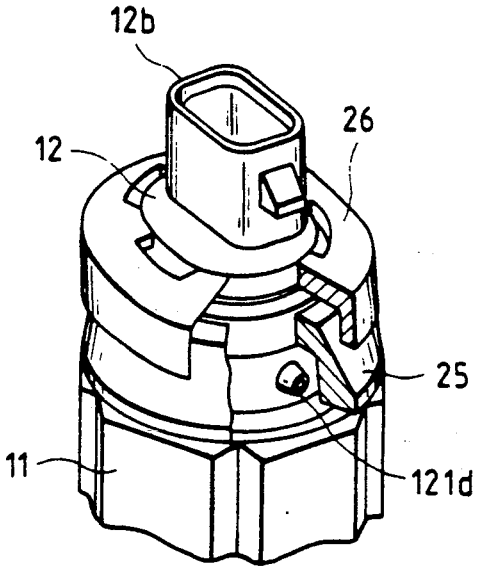

FIG. 11 shows another modification example, in which a water-proof plate 27*a* acting in the same manner as the water- proof plate 26 in FIGS. 9 and 10 is formed integrally with a connector housing 27 of a female connector fitted to a connector housing 12*a*.

As has been described, according to the present invention, an atmosphere chamber is not communicated with the atmosphere directly. Accordingly, even if water intrudes through an air vent hole, the water is evaporated or the like on the way of a groove in the outer circumferential surface of an insulating cap so that the water cannot reach the atmosphere chamber, and water is repelled at the entrance of the air vent hole so that the quantity of water intruding into the groove of the insulating cap is minimized. Accordingly, it is possible to prevent water from entering the atmosphere chamber through the air vent hole which makes the atmosphere chamber communicate with the atmosphere, so that it is possible to eliminate the cause of erroneous operation.

In addition, water intruding into a space through a gap between a water-proof cover and an attachment portion therewith cannot enter the atmosphere chamber through the air vent hole, and the intruding water is discharged through the gap, so that it is possible to prevent water from intruding into the atmosphere chamber. In addition, since a water-proof plate prevents high pressure water from being given directly and intruding, it is seldom that water intrudes into a circumferential groove through the gap, so that it is possible to eliminate the cause of erroneous operation.

What is claimed is:

1. A pressure switch, comprising:

a diaphragm held between an insulating cap and a conductive body to form an atmosphere chamber, defined by said insulating cap and said diaphragm, and a pressure chamber, defined by said conductive body and said diaphragm;

a fixed contact provided on said insulating cap;

a movable contact, provided on said diaphragm, for alternatively contacting and not contacting said fixed contact to detect a pressure in said pressure chamber;

communication means, provided in said insulating cap, for communicating said atmosphere chamber with the atmosphere; and water proof means for covering said communication means to prevent water from intruding into said atmosphere chamber, wherein said communication means includes a groove formed on an outer circumference of said insulating cap along a circumferential surface thereof, and one end of said groove communicates with said atmosphere chamber.

2. A pressure switch as claimed in claim 1, wherein said water proof means includes a water proof cover covering said groove, and a air vent hole which is formed in said water proof cover to communicate the other end of said groove with the atmosphere.

3. A pressure switch as claimed in claim 1, wherein said water proof means includes a water proof cover covering said groove to form a space along said groove.

4. A pressure switch as claimed in claim 3, wherein said communication means includes an opening of an air vent hole is projected into said space.

5. A pressure switch as claimed in claim 3, wherein said water proof means includes a gap for communicating said space with the atmosphere and for discharging water which enter into said space, which is formed between said water proof cover and said insulating cap and between said water proof cover and said conductive body.

6. A pressure switch as claimed in claim 5, wherein said water proof means includes a water proof plate, for preventing water from intruding into said gap directly, provided on said insulating cap to cover said water proof cover.

7. A pressure switch as claimed in claim 2, wherein said water proof cover is made of a water repellent material.

* * * * *